US005643158A

United States Patent [19]

Clementi

[11] Patent Number: 5,643,158

[45] Date of Patent: Jul. 1, 1997

[54] UPPER BODY SHAPING EXERCISE DEVICE

[76] Inventor: David Clementi, 84 Mayflower Ave., Massapequa Park, N.Y. 11762

[21] Appl. No.: 489,629

[22] Filed: Jun. 12, 1995

[51] Int. Cl.[6] ..... A63B 21/00

[52] U.S. Cl. ..... 482/121; 482/45; 482/46; 482/126; 482/127

[58] Field of Search ..... 482/121, 124, 482/126, 127, 128, 45, 46

[56] References Cited

U.S. PATENT DOCUMENTS

| | | | |
|---|---|---|---|
| 1,023,756 | 4/1912 | Pons | 482/126 |
| 2,818,253 | 12/1957 | Zito | 482/46 |
| 4,805,899 | 2/1989 | Roehlk | 482/127 X |
| 4,946,161 | 8/1990 | Cantieni-Habegger et al. | 482/126 |

FOREIGN PATENT DOCUMENTS

| | | | |
|---|---|---|---|
| 1131654 | 10/1968 | United Kingdom | 482/46 |

*Primary Examiner*—Richard J. Apley
*Assistant Examiner*—Kim M. Lee
*Attorney, Agent, or Firm*—Michael I. Kroll

[57] ABSTRACT

An improved upper body shaping exercise device which comprises a pair of handles, in which each handle can be grasped by one hand of a person. A structure extends between the handles, for highly resisting when the handles are twisted in opposite directions by the hands of the person, so that the hands, arms and shoulders of the person will be exercised.

5 Claims, 2 Drawing Sheets

UPPER BODY SHAPING EXERCISE DEVICE

BACKGROUND OF THE INVENTION

1. Field of the Invention

The instant invention relates generally to muscle-building apparatuses and more specifically it relates to an improved upper body shaping exercise device.

The physical training of the human body to improve the way it functions is known as exercise. Exercise can be categorized as either active or passive. Exercise involving voluntary physical effort such as walking, swimming, bicycling, and jogging is known as active exercise. Passive exercise involves a machine or the action of another person. It includes many physical therapy techniques.

The body's capacity to perform work and defend itself against disease, infection, and the effects of physical stresses such as heat or cold is a measure of physical fitness. The degree of fitness required is related to the degree of stress the body must overcome.

Specific types of physical fitness are required for each person's body to meet special demands. For example, if a job requires that unusually heavy loads be moved, additional strength in certain muscles must be developed. Through exercise or work, muscles develop strength. Nerve-muscle coordination is also improved. A body's ability to change posture suddenly requires orthostatic fitness. Orthostatic fitness can be determined by measuring how well the blood circulation can adjust to a quick change of posture, such as standing up after lying down.

Bursts of physical activity of maximum effort lasting less that ten seconds require anaerobic fitness. This is the ability of cells to work without oxygen. Anaerobic activity involves sudden rigorous movements such as sprinting to catch a bus or an extra burst of speed needed to make a touchdown. During anaerobic exercise, intense muscle activity is required. This activity exceeds the capacity of the heart and lungs to supply oxygen to the cells.

When anaerobic activity ends, the individual is left gasping for breath while heart and lungs are hard at work supplying oxygen to reverse this oxygen debt condition. Any sport or activity that occasionally requires short bursts of energy followed by long pauses is considered an anaerobic activity.

Exhaustive efforts of long duration require aerobic fitness. This type of exercise is distinguished by the body's ability to transport and consume oxygen efficiently. Running, swimming, bicycling, and cross-country skiing are examples of aerobic exercise. Aerobic exercise is characterized by the continuous, moderately strenuous effort that occurs at a pace enabling the heart and lungs to supply the oxygen needed by the muscles.

In describing the effects of exercise and physical conditioning, it is necessary to differentiate between health and fitness, and between fitness and skill. Health is thought by some to be the absence of disease. More specifically, it is the capacity of all body organs and systems to function at high levels. Fitness relates to performance and survival.

Usually, but not always, good fitness requires good health. Many exceptions are seen in sports competition. Intensely motivated and competitive athletes, even when ill or injured, have won contests and broken world records. During past Olympic contests athletes suffering from such physical disorders as infections, dysentery, flu, and broken bones have performed with superior skill. In contrast, there are perfectly healthy individuals who are unable to perform strenuous work because their bodies are poorly conditioned. Generally, however, a skilled performance is a good indication that the person is physically fit and in good heath.

2. Description of the Prior Art

Numerous muscle building apparatus have been provided in prior art that are adapted to be utilized by persons to exercise for the purposes of muscular enhancement. While these units may be suitable for the particular purpose to which they address, they would not be as suitable for the purposes of the present invention as heretofore described.

SUMMARY OF THE INVENTION

A primary object of the present invention is to provide an improved upper body shaping exercise device that will overcome the shortcomings of the prior art devices.

Another object is to provide an improved upper body shaping exercise device that will produce a high-resistance exercise for the hands, arms and shoulders by a person twisting a pair of handles in opposing directions that are attached to a coil spring.

An additional object is to provide an improved upper body shaping exercise device that is compact, lightweight, portable and quick to assemble, so that it can be used by all types of people.

A further object is to provide an improved upper body shaping exercise device that is simple and easy to use.

A still further object is to provide an improved upper body shaping exercise device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
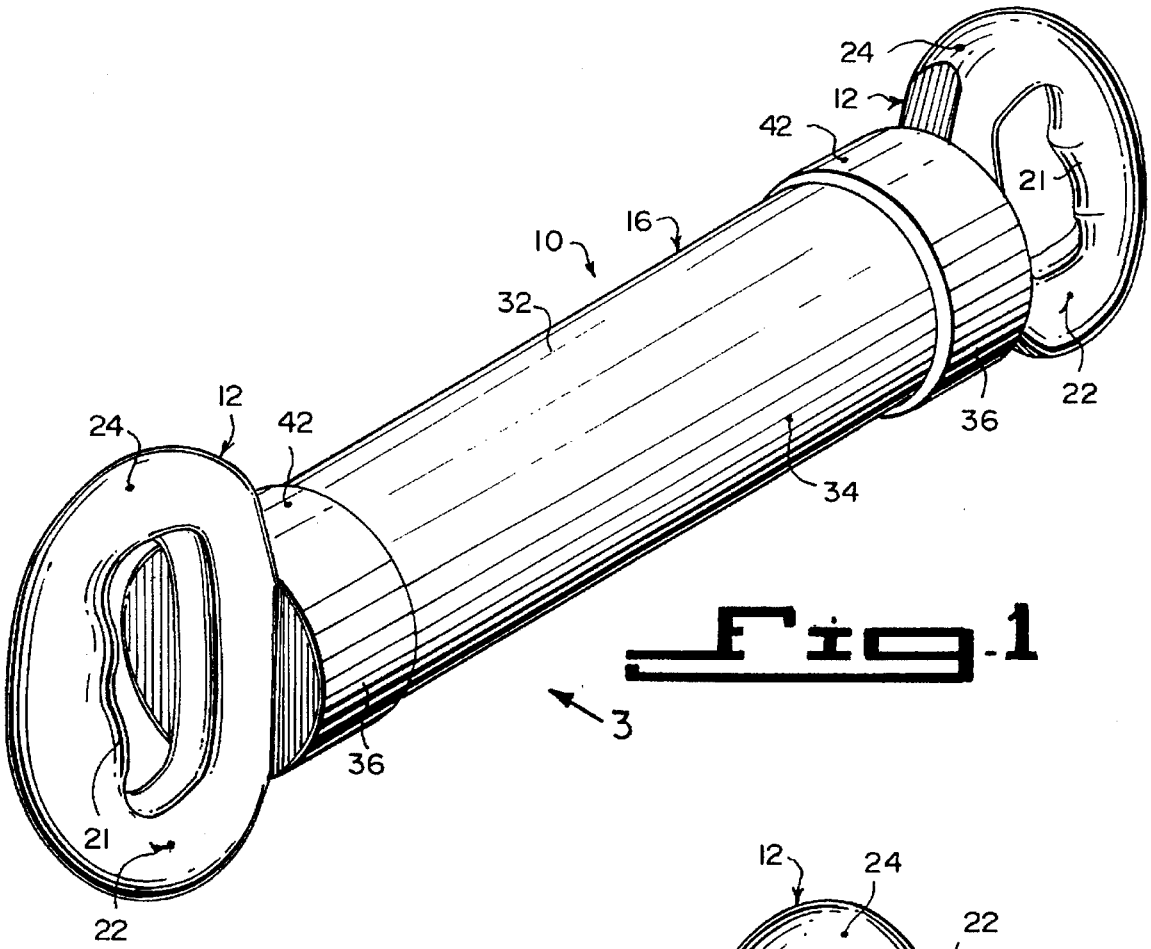
FIG. 1 is a perspective view of the instant invention.
Figure 2:
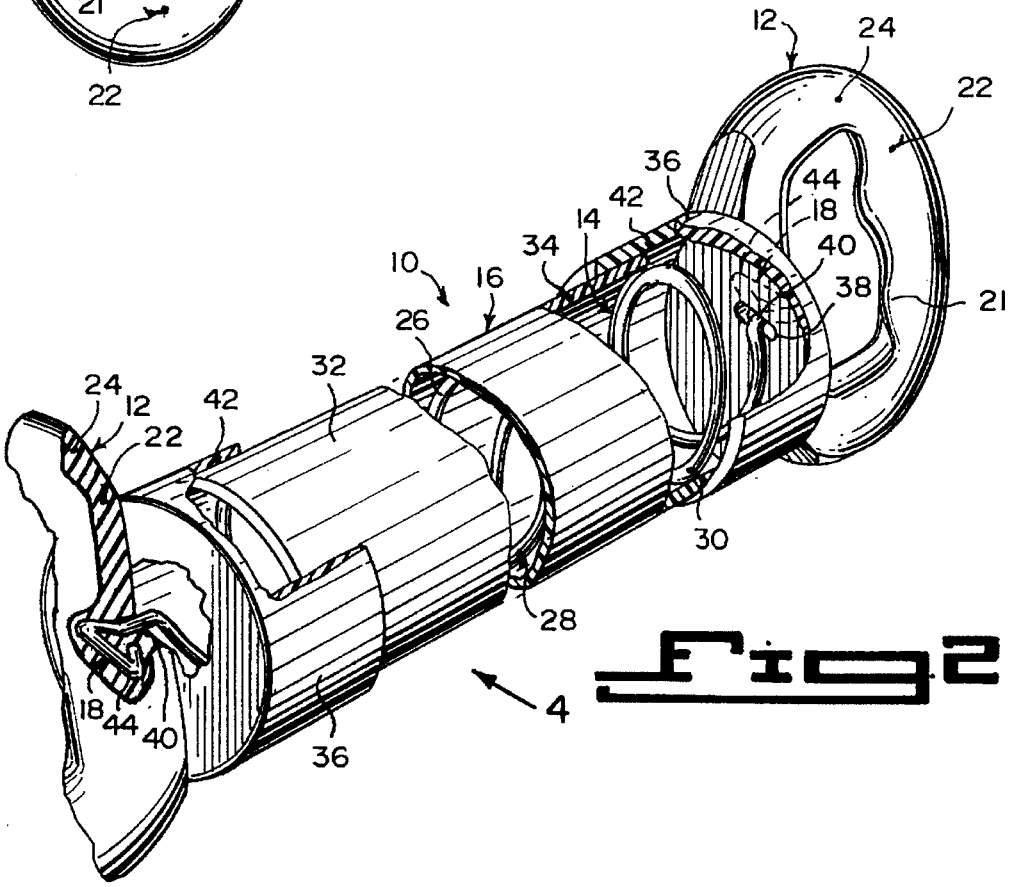
FIG. 2 is a perspective view similar to FIG. 1, with parts broken away and in section.
Figure 3:
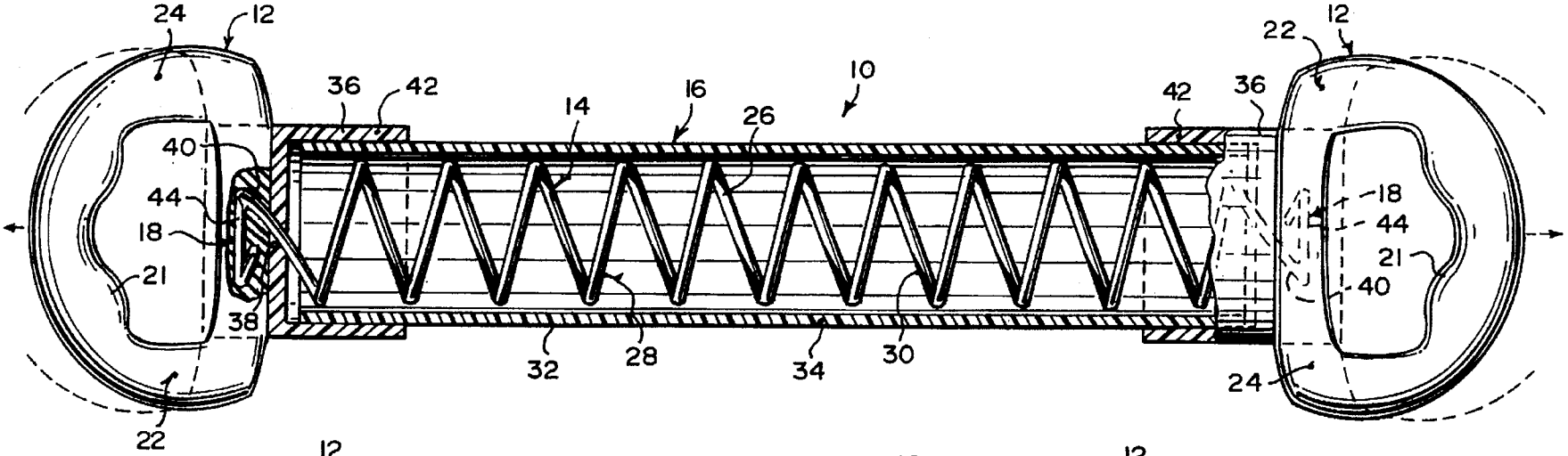
FIG. 3 is a front elevational view taken in the direction of arrow 3 in FIG. 1, with parts broken away and in section.
Figure 4:
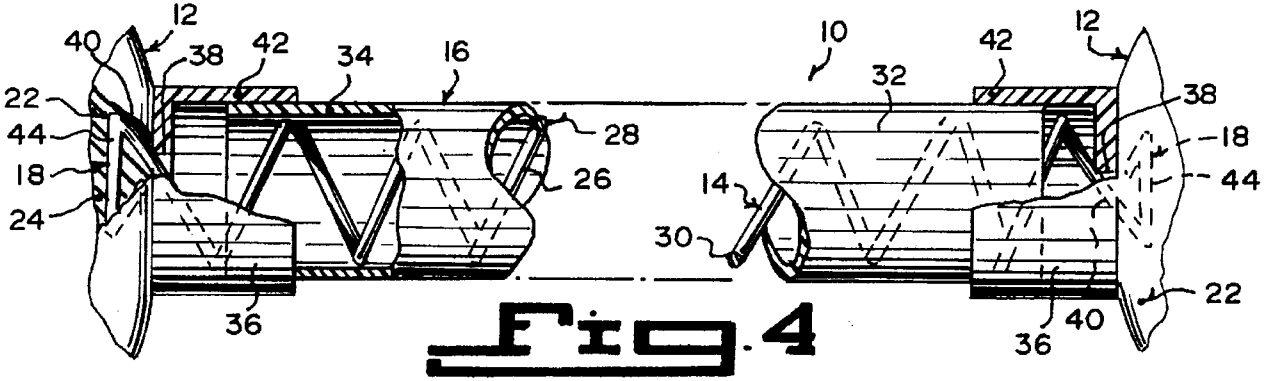
FIG. 4 is a front elevational view taken in the direction of arrow 4 in FIG. 2, with parts broken away and in section.

Turning now descriptively to the drawings, in which similar reference characters denote similar elements throughout the several views, FIGS. 1 through 4 illustrate an improved upper body shaping exercise device 10, which comprises a pair of handles 12, in which each handle 12 can be grasped by one hand of a person. A structure 14 extends between the handles 12, for highly resisting when the handles are twisted in opposite directions by the hands of the person, so that the hands, arms and shoulders of the person will be exercised.

A facility 16 is for covering the highly resisting structure 14, so as to enhance the appearance of the device 10. Elements 18 are for locking opposite ends of the highly resisting structure 14 to the handles 12.

Each handle 12 is a D-shaped member having finger depressions 22. Each handle 12 is fabricated out of a strong durable material 22. The strong durable material 22 is hard rubber 24.

The highly resisting structure 14 is an elongated coil spring 26. The highly resisting structure 14 is fabricated out of a strong resistive material 28. The strong resistive material 28 is a stiff steel wire 30.

The covering facility 16 is an elongated cylindrical housing 32, to encompass the highly resisting structure 14 therein. The elongated cylindrical housing 32 is fabricated out of plastic 34.

The covering facility 16 further includes a pair of end caps 36. Each end cap 36 fits between an end of the elongated cylindrical housing 32 and one handle 12. Each end cap 36 has a slot 38 to allow one end 40 of the highly resisting structure 14 to extend therethrough and into the handle 12. Each end cap 36 is fabricated out of plastic 42. Each element includes one end 40 of the elongated coil spring 26 folded back upon itself into a generally triangular configuration 44 which is embedded into one handle 12.

OPERATION OF THE INVENTION

To use the improved upper body shaping exercise device 10, the following steps should be taken:

1. Grip each handle 12 with each hand.
2. Twist the first handle 12 clockwise.
3. Twist the second handle 12 counterclockwise to apply pressure on the coil spring 26.
4. Now twist the first handle 12 counterclockwise.
5. Now twist the second handle 12 clockwise.
6. Repeat steps 2 to 5 over and over again to exercise the hands, arms and shoulders.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved upper body shaping exercise device which comprises:

a) a pair of handles of D-shaped configuration in which each said handle can be grasped and twisted by one hand of a person;

b) means comprising a single elongated steel spring extending between and joining said handles for highly resisting the twisting of said handles in opposite directions by the hands of said person to exercise the hands, arms and shoulders of said person;

c) elongated cylindrical housing means enclosing said steel spring the ends of which housing means being open and spaced from said handles; and d) end cap means mounted on each said handle comprising a cylindrical member closed at one end, the closed end being attached to a handle and the open end enclosing an end of said cylindrical housing means, said closed end of said cylindrical member having a slot to allow one end of said steel spring to extend therethrough and enter said handle folding back upon itself into a generally triangular configuration embedded into said handle to prevent said spring from coming loose during twisting.

2. An improved upper body shaping exercise device as recited in claim 1, wherein each said handle is has finger depressions.

3. An improved upper body shaping exercise device as recited in claim 1, wherein each said handle is fabricated out of a strong durable material.

4. An improved upper body shaping exercise device as recited in claim 3, wherein said strong durable material is hard rubber.

5. An improved upper body shaping exercise device as recited in claim 1, wherein said elongated cylindrical housing means is fabricated out of plastic.

* * * * *